US007608027B2

(12) United States Patent
Rodriguez

(10) Patent No.: US 7,608,027 B2
(45) Date of Patent: Oct. 27, 2009

(54) EXERCISE APPARATUS

(76) Inventor: Armando Rodriguez, P.O. Box 458, Desert Hot Springs, CA (US) 92240

( * ) Notice: Subject to any disclaimer, the term of this patent is extended or adjusted under 35 U.S.C. 154(b) by 0 days.

(21) Appl. No.: 11/543,590

(22) Filed: Oct. 5, 2006

(65) Prior Publication Data

US 2008/0096739 A1 Apr. 24, 2008

(51) Int. Cl.
*A63B 21/00* (2006.01)

(52) U.S. Cl. ..... 482/126; 482/121; 482/907

(58) Field of Classification Search ..... 482/126, 482/121, 148, 907, 129, 142, 133; 128/25 E
See application file for complete search history.

(56) References Cited

U.S. PATENT DOCUMENTS

| | | | | | |
|---|---|---|---|---|---|
| 1,495,278 | A | * | 5/1924 | Titus | 482/49 |
| 1,620,910 | A | * | 3/1927 | Minnich | 482/126 |
| 1,877,218 | A | * | 9/1932 | Blank | 482/126 |
| RE28,845 | E | * | 6/1976 | Ratchford | 482/49 |
| 4,226,412 | A | * | 10/1980 | Panepinto | 482/49 |
| 4,239,212 | A | * | 12/1980 | Hickey | 482/126 |
| 4,783,067 | A | * | 11/1988 | Palmer | 482/49 |
| 4,846,306 | A | * | 7/1989 | Ventz | 182/196 |
| D353,859 | S | * | 12/1994 | Grey | D21/684 |
| 5,637,066 | A | * | 6/1997 | Chang | 482/126 |
| 5,954,622 | A | * | 9/1999 | Olschansky et al. | 482/123 |
| 5,993,361 | A | * | 11/1999 | Paoli et al. | 482/121 |
| 6,416,447 | B1 | * | 7/2002 | Harmon | 482/129 |
| 2004/0094363 | A1 | * | 5/2004 | Bagshaw | 182/196 |
| 2006/0086572 | A1 | * | 4/2006 | Martin | 182/196 |

OTHER PUBLICATIONS

PCT Wo 9108025 Epilady international Inc May 12, 1990.*

* cited by examiner

*Primary Examiner*—Jerome Donnelly
(74) *Attorney, Agent, or Firm*—Louis L. Dachs

(57) ABSTRACT

A device for holding and organizing items includes an anchor for fastening the device to an object; a strap adapted to secure the items to the device; and a connector, having an upper piece and a lower piece that pivot relative to one another, the upper piece being connected to the anchor and the lower piece being connected to the strap.

10 Claims, 3 Drawing Sheets

EXERCISE APPARATUS

BACKGROUND OF THE INVENTION

1. Field of the Invention

The invention relates to the field of exercise apparatus and, in particular, to a resistance exercise apparatus that provides a multiple of hand griping bars, such that the amount of movement required by the individual exercising can be varied with a change in position of the individual.

2. Description of Related Art

There are numerous resistance type (muscle building) exercise devices and machines available today. Some are designed to develop single groups of muscles, such as the biceps or triceps. There are, of course, multi-function exercise machines where in cables attached to a variable weight assembly connect to various apparatus rods and arms that allow for resistance training of leg, arm and back muscles. Such devices are expensive and take up a lot of space. Thus there use in most homes is not possible.

One of the simpler devices is a stretchable cord having a hand grip on either side. These usually come in various resistance levels, depending upon the thickness of the cord. Typically, one steps on the middle of the cord and pulls upward with each hand to build up the biceps. Another use is to tie one end about a support and pull on the opposite end. However, there is a disadvantage to this cord device. If one wants to adjust the movement of an arm or leg, the individual must move toward or away from the tied end of the cord. This can prove difficult if one is laying on floor or a workout bench. Also only one arm or leg can be used at a time.

Thus, it is a primary object of the invention to provide a resistance exercise apparatus.

It is another primary object of the invention to provide a resistance exercise apparatus that is inexpensive.

It is a further object of the invention to provide a resistance exercise apparatus that does not take up much storage space and thus can be used at home.

It is a still further object of the invention to provide a resistance exercise apparatus that does not require the individual to move to vary the amount of the individual user's motion.

SUMMARY OF THE INVENTION

The invention is a resistance exercise apparatus. In detail, the apparatus includes The apparatus includes a first end bar having first and second ends, the first bar having first and second spacers mounted on the first and second ends. A second end bar is included having first and second ends. At least one intermediate bar between is positioned between the first and second end bars, the at least one intermediate bar having first and second ends, with first and second spacers mounted on the first and second ends thereof. The first and second ends of the first and second end bars and the at least one intermediate bar have first and second apertures extending through. First and second stretchable cords have first and second ends attached to said first and second end bars and extending through the fist and second apertures in the first and second end bars and the at least one intermediate bar.

The first and second end bars and the at least one intermediate bar are preferably round having a radius. The spacers have first ends attached to the bars and second ends having a concave surface with a radius equal to the radius of the bars. The length of spacers is selected to provide for the placement of a hand between adjacent bars. Preferably, the bars and the spacers are made of plastic tubing.

In operation, the pair of straps is used to attach the apparatus to a structure. An individual then places his hands between the first en bar and the at least one intermediate bar, or between intermediate bars, if there is more than one; or between the at least intermediate bar and second ender depending upon his distance from the apparatus. Alternately, the individual can select the hand location to adjust movement of the bars. When the individual pulls on the selected bar away from the second end bar, the stretchable first and second cords offer resistance.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of an example. It is to be expressly understood, however, that the drawings are for purposes of illustration and description only and are not intended as a definition of the limits of the invention.

DESCRIPTION OF THE PREFERRED EMBODIMENT

Figure 1:
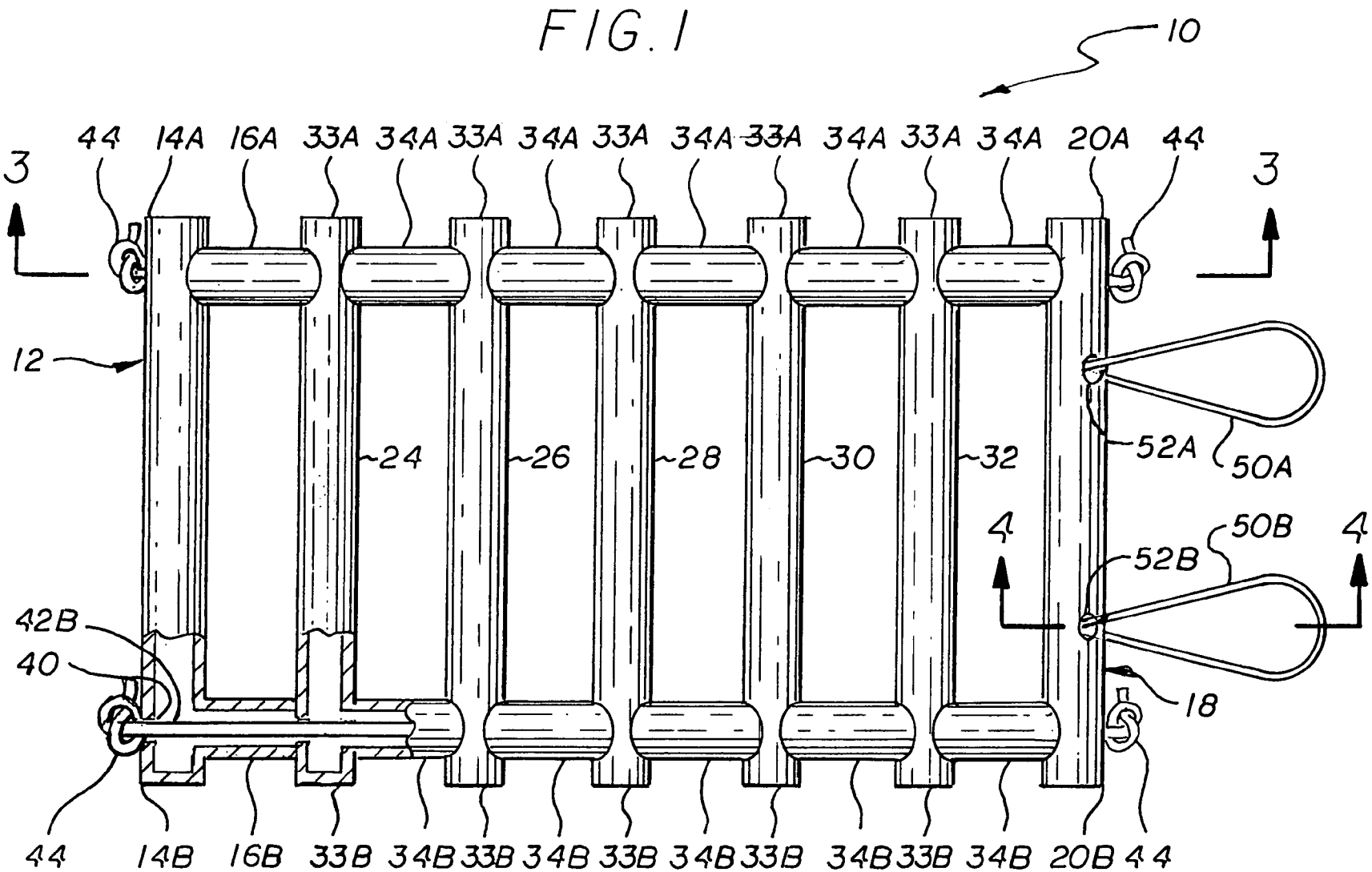
FIG. 1 is a top view of the apparatus.
Figure 2:
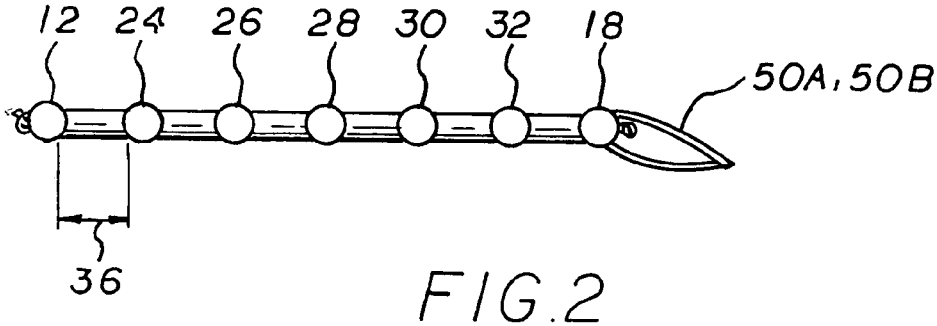
FIG. 2 is a side view of the apparatus.

Referring to FIGS. 1 and 2, the device, generally indicated by numeral 10, includes a first end bar 12 having first and second ends 14A and 14B with integral first and second spacers 16A and 16B. A second end bar 18 includes first and second ends 20A and 20B A plurality of intermediate bars, as illustrated, 5 bars, 24, 26, 28, 30, and 32 are mounted between the first and second end bars 12 and 18, all having first and second ends 33A and 33B with integral spacers 34A and 34B, respectively, mounted thereon. The length 36 of each spacer 16A, 16B, 34A and 34B are sufficient to allow a persons hand to be inserted between the bars, for example between bars 12 and 24.

A hole or aperture 38 extends through all the bars 12, 18, 24, 26, 28, 30 and 32 and spacers 22A, and spacers 34A on the first ends 20A and 34A thereof. A second hole or aperture 40 extends through all of the bars 12, 18, 24, 26, 28, 30 and 32 and spacers 22B, and spacers 34B on the first ends 20B and 34BA thereof. First and second stretchable cords 42A and 42B extend through the holes 28 and 40 secured by knots 44 at bars 12 and 18. Thus all the bars 12, 18, 24, 26, 28, 30 and 32 are secured together. Note that a clamp or other fastening device (not shown) could be used to secure the cords 42A and 42B.

Figure 4:
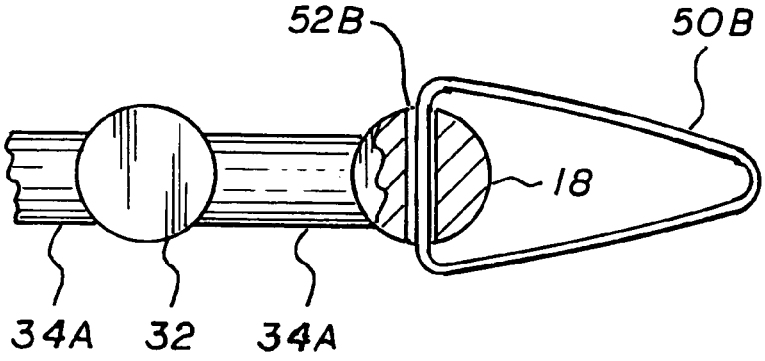
FIG. 4 is a cross-sectional view of FIG. 1 taken along the line 4-4.
Figure 3:
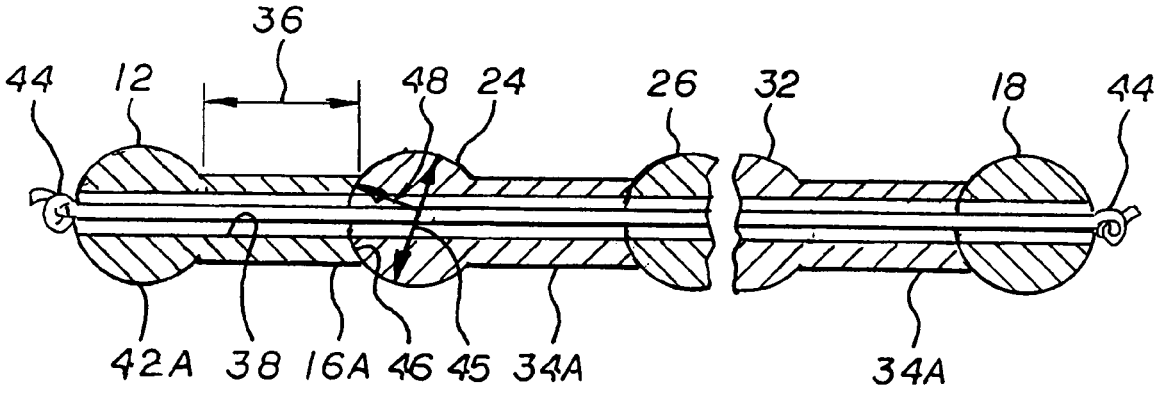
FIG. 3 is a partial cross-sectional view of the apparatus taken along the line 3-3.

Referring to FIG. 3, the all the bars have a similar diameter selected to be easily griped by the hand. For example bar 24 has a diameter 45 of between 0.75 to 1.25 inch in diameter (radius is 0.375 to 0.675 inch). Also the ends 46 of the spacers 22A, 22B, 34A and 34B all have matching radius' 48. Thus the bars 12, 18, 24, 26, 28, 30 and 32 all automatically align with each other. Referring to FIG. 4, the end bar 18 includes looped straps 50A and 50B on each end 22A and 22B. These straps extend into a pair of holes 52A and 52B. Note that, while looped straps are shown, other types of attaching devices can be used.

Figure 5:
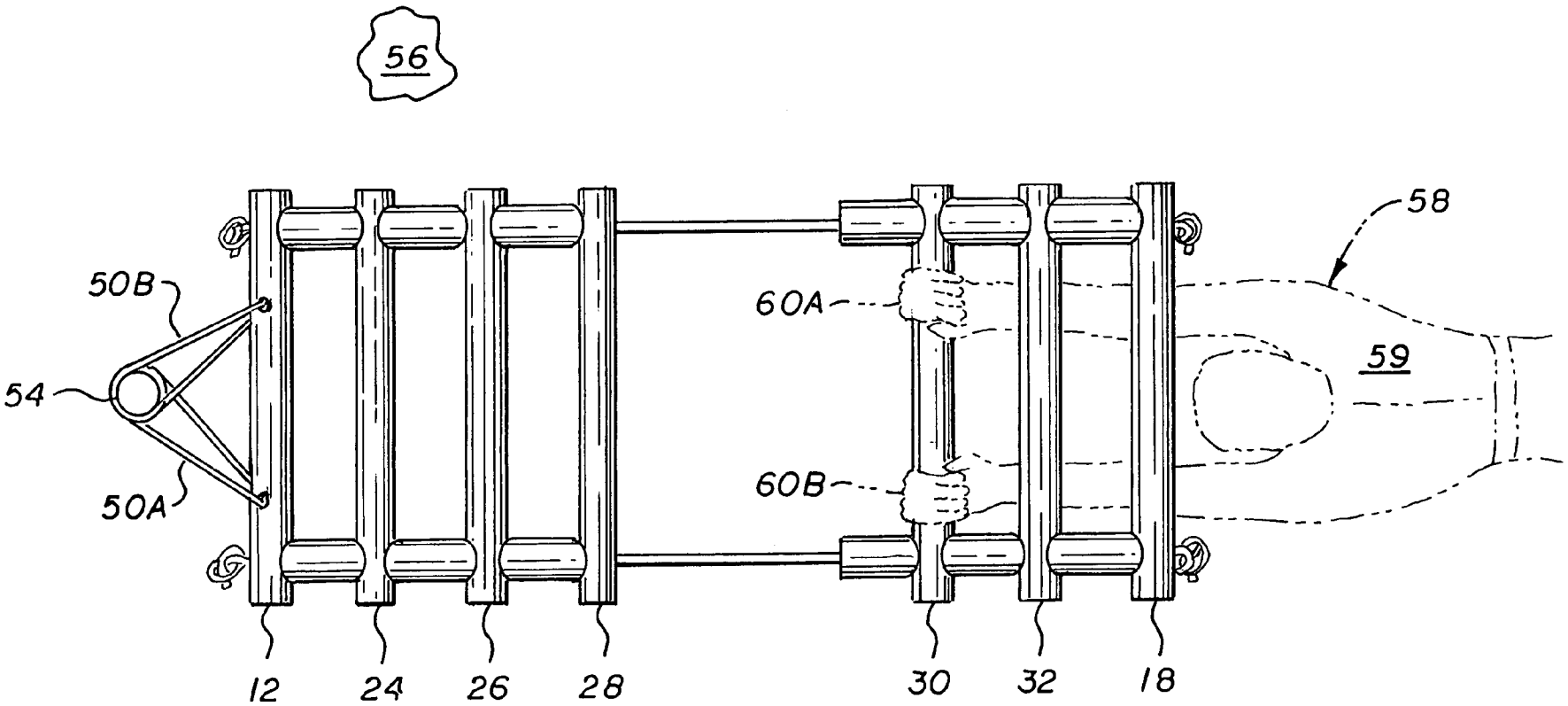
FIG. 5 is a top view of an individual using the apparatus.

Referring to FIG. 5, in operation, the straps 52A and 52B are wrapped around a post 54 mounted on the floor 56. An individual 58 is illustrated lying on the floor 56. The individual grips bar 12 or one of the intermediate bars 24, 26, 28, 30 or 32 with his hands 60A and 60B. As illustrated, the individual 58 is shown griping bar 30. The individual can then pull the bar 30 toward his body 59, causing the cords 42A and 42B to stretch offering resistance. By having a plurality of bars, the distance moved can be varied by griping different bars.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to industries that manufacture exercise equipment.

The invention claimed is:

1. A resistance exercise apparatus comprising:

a first end bar having first and second ends, said first end bar including first and second spacers attached to said first and second ends;

a second end bar having first and second ends;

at least one intermediate bar between said first end bar and second end bars, said at least one intermediate bar having first and second ends including third and fourth spacers attached to said first and second ends thereof;

said first and second ends of said first end bar and second end bars and said at least one intermediate bar having first and second apertures, respectively, extending through; and first and second stretchable cords having first and second ends attached to said first and second end bars and extending through said fist and second apertures in said first and second end bars and said at least one intermediate bar said first and second stretchable cords biasing said first end bar and said at least one intermediate bar toward said second bar such that all of said bars are in contact with each other.

2. The apparatus as set forth in claim 1 wherein means are mounted to said second end bar for attaching to an external structure.

3. The apparatus as set forth in claim 2 further comprising:

said first and second end bars and said at least one intermediate bar are round having a radius; and said first, second, third and fourth spacers having first ends attached to said first end bar and said at least one intermediate bars, respectively, and second ends having a concave surface with a radius equal to the radius of said bars.

4. The apparatus as set forth in claim 3 wherein the length of said first, second, third and fourth spacers is selected to provide for the placing of hand between adjacent bars.

5. The apparatus as set forth in claim 4 wherein the said bars and said spacers are made of plastic tubing.

6. An exercise apparatus comprising:

first and second end bars;

at least one intermediate bar between said first and second end bars, said at least one intermediate bar having apertures extending there through at each end;

means to space said first and second end bars and said at least one intermediate bar from each other, and first and second stretchable cords attached to said fist and second end bars and passing through said first and second apertures of said at least one intermediate bar, said first and second stretchable cords biasing said first end bar and said at least one intermediate bar toward said second bar, such that all of said bars are in contact with each other.

7. The apparatus as set forth in claim 6 wherein second means are mounted to said second end bar assembly for attaching to an external structure.

8. The apparatus as set forth in claim 7 wherein said means to space said first and second end bars and said at least one intermediate bar from each other are spacers mounted to said first end bar and said at least one intermediate bar assembly.

9. The apparatus as set forth in claim 8 further comprising:

said first and second end bars and said at least one intermediate bar are round having a radius; and said spacers having first ends attached to said bars and second ends having a concave surface with a radius equal to the radius of said bars.

10. The apparatus as set forth in claim 9 wherein the length of said spacers is selected to provide for the placing of hand between adjacent bars.

* * * * *